US012484684B2

(12) United States Patent
Ogawa et al.

(10) Patent No.: US 12,484,684 B2
(45) Date of Patent: Dec. 2, 2025

(54) MEDICAL SOLUTION APPLYING TOOL AND MEDICAL SOLUTION APPLYING CONTAINER INCLUDING SAME

(71) Applicant: TAISEI KAKO CO., LTD., Osaka (JP)

(72) Inventors: Yukihiro Ogawa, Osaka (JP); Satoshi Miyatake, Osaka (JP); Shota Noma, Osaka (JP)

(73) Assignee: TAISEI KAKO CO., LTD., Osaka (JP)

( * ) Notice: Subject to any disclaimer, the term of this patent is extended or adjusted under 35 U.S.C. 154(b) by 0 days.

(21) Appl. No.: 18/579,924

(22) PCT Filed: Jul. 20, 2022

(86) PCT No.: PCT/JP2022/028185
§ 371 (c)(1),
(2) Date: Jan. 17, 2024

(87) PCT Pub. No.: WO2023/013414
PCT Pub. Date: Feb. 9, 2023

(65) Prior Publication Data

US 2024/0324751 A1 Oct. 3, 2024

(30) Foreign Application Priority Data

Aug. 6, 2021 (JP) ..... 2021-129551

(51) Int. Cl.
*A45D 34/04* (2006.01)
*A46B 11/00* (2006.01)

(52) U.S. Cl.
CPC ..... *A45D 34/045* (2013.01); *A45D 34/04* (2013.01); *A46B 11/0013* (2013.01)

(58) Field of Classification Search
CPC ... A46B 11/0013; A45D 34/04; A45D 34/045
(Continued)

(56) References Cited

U.S. PATENT DOCUMENTS 4,748,990 A * 6/1988 Brown ..... A45D 34/042 401/277
6,176,632 B1 * 1/2001 Kageyama ..... A46B 11/0079 401/206

(Continued)

FOREIGN PATENT DOCUMENTS

JP S59-69175 U 5/1984
JP 2003-010342 A 1/2003

(Continued)

OTHER PUBLICATIONS

International Search Report dated Sep. 6, 2022, for the corresponding Patent Application No. PCT/JP2022/028185, with English translation.

(Continued)

*Primary Examiner* — Jennifer C Chiang
(74) *Attorney, Agent, or Firm* — LUCAS & MERCANTI, LLP

(57) ABSTRACT

A medical solution applying tool is composed of a brush, an inside stopper to which the brush is attached, and a cap including a fit-insertion closed-end hole into which the brush and a distal end portion of the inside stopper are fittingly inserted. The inside stopper is provided with a holding portion holding the cap such that the brush and the distal end portion of the inside stopper are fittingly inserted into the fit-insertion closed-end hole, whereas the cap is provided with a held portion held by the holding portion.

8 Claims, 6 Drawing Sheets

(58) Field of Classification Search
USPC ..... 401/261–263, 269
See application file for complete search history.

(56) References Cited

U.S. PATENT DOCUMENTS

| | | | | |
|---|---|---|---|---|
| 8,075,215 | B2 * | 12/2011 | Albisetti | A45D 34/042 401/282 |
| 2005/0169696 | A1 | 8/2005 | Albisetti | |
| 2008/0019763 | A1 * | 1/2008 | Kim | A45D 34/042 401/269 |

FOREIGN PATENT DOCUMENTS

| | | | |
|---|---|---|---|
| JP | 2005-246051 | A | 9/2005 |
| JP | 2016-050017 | A | 4/2016 |
| JP | 2021-091449 | A | 6/2021 |

OTHER PUBLICATIONS

Extended European Search Report dated Nov. 5, 2024, which was issued for the corresponding European Patent Application No. 22852838.6, 9 pages.
Office Action dated Sep. 30, 2024, which was issued for the corresponding Japanese Patent Application No. 2021-129551, 5 pages, with English translation.

* cited by examiner

MEDICAL SOLUTION APPLYING TOOL AND MEDICAL SOLUTION APPLYING CONTAINER INCLUDING SAME

CROSS REFERENCE TO RELATED APPLICATION

This Application is a 371 of PCT/JP2022/028185 filed on Jul. 20, 2022, which claimed priority of Japanese Patent Application No. 2021-129551 filed on Aug. 6, 2021, both of which are incorporated herein by reference.

FIELD OF THE INVENTION

The present invention relates to a medical solution applying tool for a medical solution applying container used for a variety of medical solutions such as the one applied to human skin and relates to a medical solution applying container including the same.

BACKGROUND ART

There has been conventionally developed a type of medical solution applying container composed of a medical solution container body for storing a medical solution and a medical solution applying tool that includes a brush for applying the medical solution to human skin or so forth, an inside stopper, and a cap (e.g., Patent Literature 1).

In general, such a medial solution applying container as described above is configured such that the cap is engaged with the outside of an opening of the medical solution container body. Because of this, in delivery of the medical solution applying container from a manufacturer thereof to a medical solution manufacturer, the medical solution applying container has been disassembled by separating the medical solution applying tool from the medical solution container body and further separating the cap from the medical solution applying tool; thereafter, in the medical solution manufacturer, the medical solution container body has been filled with the medical solution, and then, the brush (and the inside stopper) and the cap have been sequentially assembled thereto.

CITATION LIST

Patent Literature

Patent Literature 1: Japan Laid-open Patent Application Publication No. 2021-91449

SUMMARY OF THE INVENTION

Technical Problem

However, when employing the procedure described above, the medical solution manufacturer has caused a defect that the brush is damaged due to interference of the cap with the distal end of the brush caused by mistake when the cap is assembled to the medical solution container body, hitting the uncovered brush against somewhere, or some kind of accident.

The present invention has been produced in view of the drawback described above. It is an object of the present invention to provide a medical solution applying tool and a medical solution applying container including the same, by which it is made possible to avoid damage of a brush from occurring when the medical solution applying tool is assembled to a medial solution container body after the medical solution container body is filled with a solution.

Solution to Problem

According to an aspect of the present invention, a medical solution applying tool is provided. The medical solution applying tool includes a brush, an inside stopper to which the brush is attached, and a cap including a fit-insertion closed-end hole into which the brush and a distal end portion of the inside stopper are fittingly inserted. The inside stopper is provided with a holding portion holding the cap such that the brush and the distal end portion of the inside stopper are fittingly inserted into the fit-insertion closed-end hole. Besides, the cap is provided with a held portion held by the holding portion.

Preferably, the holding portion is made in shape of either a male or female thread, whereas the held portion is made in shape of either a female or male thread.

Preferably, the inside stopper is provided with a cap contact surface, contacted to an inside of the cap, on an outside thereof. Besides, the cap contact surface is made in shape of a taper surface slanting from a center of the inside stopper to the outside of the inside stopper in a direction oriented from a distal end of the inside stopper, i.e., an end at which the brush is attached to the inside stopper, to an opposite side of the distal end.

Preferably, the cap is provided with an inside stopper contact surface, contacted to an outside of the inside stopper, on an inside thereof. Besides, the inside stopper contact surface is made in shape of a taper surface slanting from an outside of the cap to a center of the cap in a direction oriented from an opening of the fit-insertion closed-end hole to a closed end of the fit-insertion closed-end hole.

Preferably, the holding portion is provided in a vicinity of the cap contact surface.

Preferably, the held portion is provided in a vicinity of the inside stopper contact surface.

Preferably, the inside stopper includes a medical solution container body inserted-and-mounted opening, to which a neck portion of a medical solution container body is inserted and mounted, and that is provided in an end portion of the inside stopper located on an opposite side of the end at which the brush is attached to the inside stopper. Besides, the end portion provided with the medical solution container body inserted-and-mounted opening has an outer diameter greater than or equal to a maximum outer diameter of the cap.

According to another aspect of the present invention, a medical solution applying container is provided that includes the medical solution applying tool configured as described above and a medical solution container body storing therein a medical solution.

Effects of Invention

In the medical solution applying tool for a medical solution applying container according to the present invention, the inside stopper, composing part of the medical solution applying tool, is provided, on the outside thereof, with the holding portion holding the cap such that the brush and the distal end portion of the inside stopper are fittingly inserted into the fit-insertion closed-end hole of the cap, whereas the cap is provided, on the inside thereof, with the held portion held by the holding portion.

Accordingly, when the medical solution applying container is delivered from a manufacturer thereof to a medical solution manufacturer, while being disassembled by separating the medical solution applying tool from the medical solution container body, it is made possible to transport the medical solution applying container in a condition that the holding portion of the inside stopper and the held portion of the cap are fitted to each other, while the brush and the distal end portion of the inside stopper are fittingly inserted into the fit-insertion closed-end hole of the cap.

Therefore, it is made possible to avoid occurrence of a defect that the brush is damaged in the medical solution manufacturer due to interference of the cap with the distal end of the brush caused by mistake when the cap is assembled to the inside stopper, hitting the uncovered brush against somewhere, or some kind of accident.

BRIEF DESCRIPTION OF THE DRAWINGS

Referring now to the attached drawings which form a part of this original disclosure.

DETAILED DESCRIPTION OF EMBODIMENTS (Configuration of Medical Solution Applying Container 10)

An exemplary configuration of a medical solution applying container 10 to which the present invention is applied will be hereinafter explained with reference to drawings.

Figure 1:
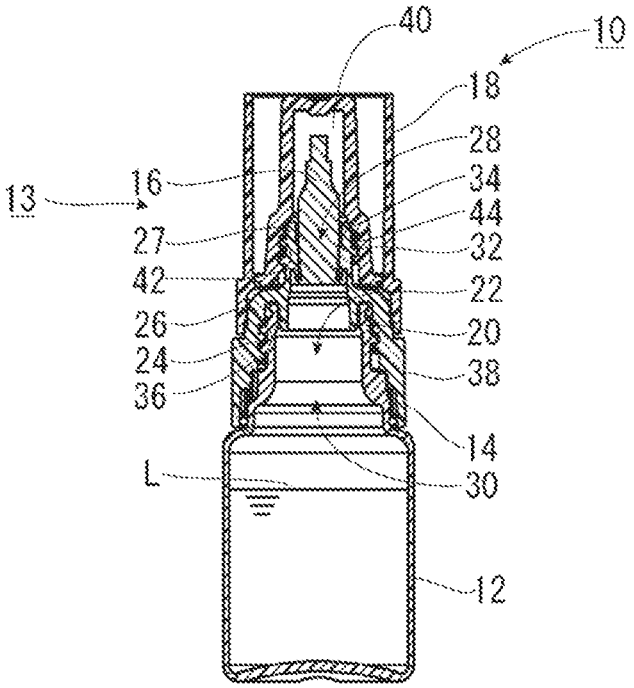
FIG. 1 is a cross-sectional view of a medical solution applying container 10 according to an exemplary embodiment.
Figure 2:
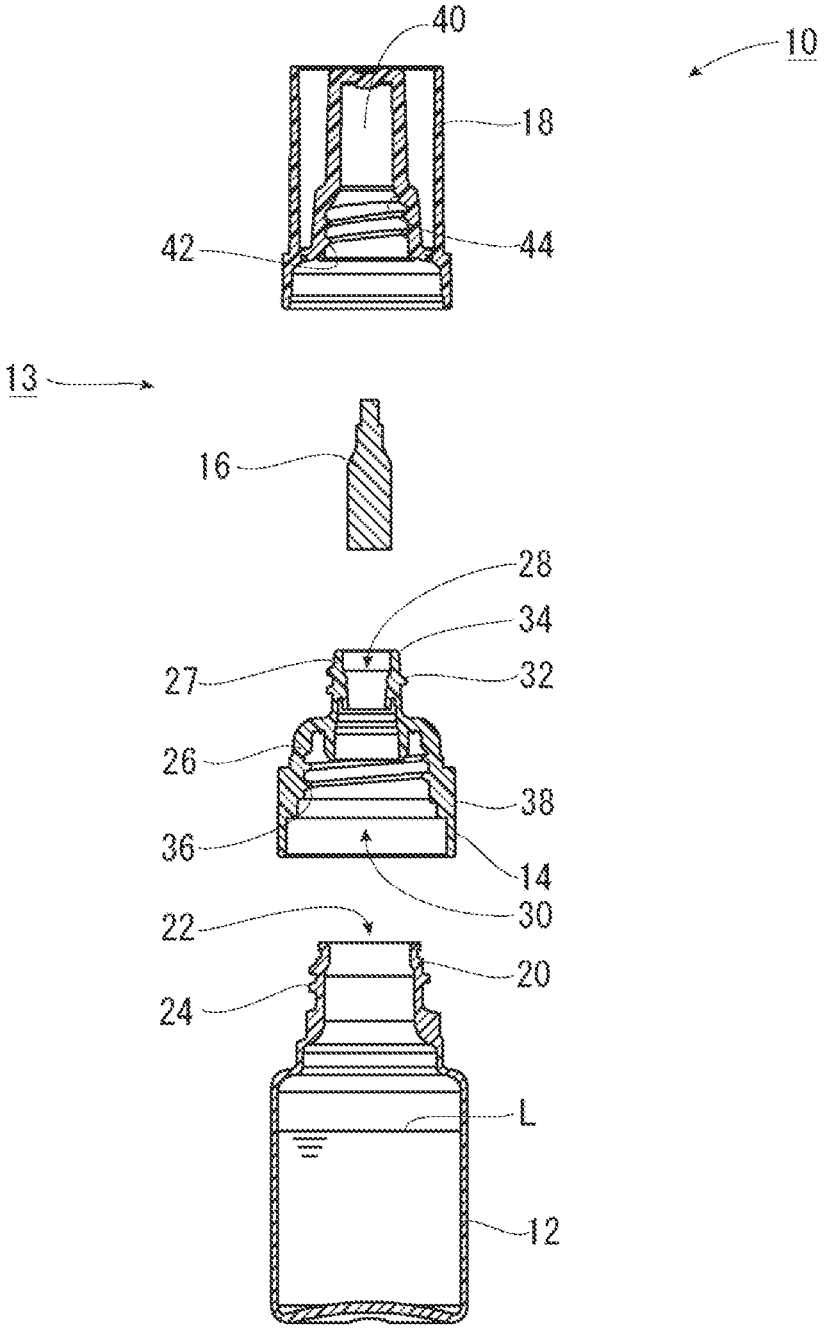
FIG. 2 is an exploded cross-sectional view of the medical solution applying container 10 according to the exemplary embodiment.

As shown in FIGS. 1 and 2, the medical solution applying container 10 is mainly composed of a medical solution container body 12 and a medical solution applying tool 13.

The medical solution container body 12 is a closed-end tubular member having an approximately columnar shape and stores a medical solution L therein. The medical solution container body 12 is provided with a neck portion 20 on a distal end portion thereof. The neck portion 20 is configured to be inserted and mounted to a medical solution container body inserted-and-mounted opening 30 provided in an end portion of an inside stopper 14. Besides, the medical solution container body 12 is provided with an opening 22 in the upper end of the neck portion 20 to pour the medical solution L therein through the opening 22. The neck portion 20 is provided with a male thread 24 on the outer periphery thereof to be screwed into a female thread 36 provided on the inner surface of the medical solution container body inserted-and-mounted opening 30 (to be described) of the inside stopper 14.

As described above, the medical solution container body 12 according to the present exemplary embodiment has the approximately columnar shape; however, the shape thereof is not limited to this, and for instance, may be approximately prismatic or may be more complex. Besides, the material of the medical solution container body 12 is not particularly limited as well, and for instance, may be at least one selected from the group consisting of polypropylene (PP), polyethylene (PE), polyester (PET), and elastomer. However, polyethylene (PE) or elastomer is optimal when the medical solution applying container 10 is used in such a manner of dripping the medical solution from a brush 16 (to be described), whereas polyethylene (PE) or polyester (PET) is preferable in attempt to make a user recognize the remaining amount of the medical solution.

The medical solution applying tool 13 is composed of the inside stopper 14, the brush 16, and a cap 18. Obviously, at least one member other than the members 14, 16, and 18 may be added to the constituent members of the medical solution applying tool 13.

The inside stopper 14 is a tubular member having an approximately columnar shape and includes an inside stopper body 26, a brush inserted-and-mounted through hole 28 provided in a lengthwise center part of a distal end portion 27 of the inside stopper body 26, and the medical solution container body inserted-and-mounted opening 30 provided on an end portion thereof (base end portion 38) located on the opposite side of the brush inserted-and-mounted through hole 28. It should be noted that the brush inserted-and-mounted through hole 28 and the medical solution container body inserted-and-mounted opening 30 are communicated with each other inside the inside stopper body 26.

Besides, the inside stopper body 26 is provided with an inside stopper male thread 32 on the outer periphery of the distal end portion 27. In the present exemplary embodiment, the inside stopper male thread 32 corresponds to "a holding portion" holding the cap 18.

Moreover, the inside stopper body 26 is provided with a cap contact surface 34, contacted to the inside of the cap 18, on the distal end of the distal end portion 27 in adjacent to the inside stopper male thread 32. The cap contact surface 34 is made in shape of a taper surface slanting from the center of the inside stopper 14 to the outside of the inside stopper 14 in a direction oriented from a distal end of the inside stopper 14, at which the brush 16 is attached to the inside stopper 14, to the opposite side of the distal end (i.e., to a base end).

Besides, the medical solution container body inserted-and-mounted opening 30 of the inside stopper 14 is configured to receive the neck portion 20 of the medical solution container body 12 inserted and mounted thereto as described above; hence, the medical solution container body inserted-and-mounted opening 30 is provided with the female thread 36 on the inner surface thereof such that the male thread 24, provided on the outer periphery of the neck portion 20 of the medical solution container body 12, is screwed therein.

As described above, the inside stopper 14 according to the present exemplary embodiment has the approximately columnar shape; however, the outer shape thereof at the base end portion 38 provided with the medical solution container body inserted-and-mounted opening 30 is not limited to this, and, for instance, may be approximately prismatic or may be more complex. Furthermore, the material of the inside stopper 14 is not particularly limited as well, and for instance, may be at least one selected from the group consisting of polypropylene (PP), polyethylene (PE), polyester (PET), and polybutylene terephthalate (PBT). The material of the inside stopper 14 is herein only required to have a stiffness that enables the brush 16 to be easily inserted into the brush inserted-and-mounted through hole 28 and enables the inside stopper 14 to be easily assembled to the medical solution container body 12.

The brush 16 is formed by collectively pressing a bundle of synthetic fibers having predetermined specific gravity and strength in an approximately columnar shape with a predetermined density. In the drawings, the medical solution L permeates the lower end portion of the brush 16 and is drawn to the upper end portion of the brush 16 by capillary action; hence, the medical solution L is configured to be applicable to a desired position on the skin or so forth by pressing the upper end portion of the brush 16 thereto.

As described above, the outer shape of the brush 16 according to the present exemplary embodiment has the approximately columnar shape; however, the outer shape thereof is not limited to this, and for instance, may be approximately prismatic or may be more complex. Besides, the material of the brush 16 is not particularly limited as well, and for instance, may be at least one selected from the group consisting of polyester (PET, PBT) fiber, polypropylene (PP) fiber, polyamide (PA) fiber, acrylic (PMMA) fiber, and polyacetal (POM) fiber.

The cap 18 is a member for avoiding occurrences of the followings when the medical solution applying container 10 is stored without being used: damage of the brush 16 and/or attachment of the medical solution L to an object or so forth due to undesired contact of the upper end of the brush 16 therewith; and natural evaporation or so forth of the medical solution L through the upper end of the brush 16.

The cap 18 according to the present exemplary embodiment has an approximately conical shape and is provided with a fit-insertion closed-end hole 40 on the inner side thereof such that the brush 16 and the distal end portion 27 of the inside stopper 14 are fittingly inserted thereto. Besides, the fit-insertion closed-end hole 40 (the inside of the cap 18) is provided with a cap female thread 42 on the inner surface thereof. In the present exemplary embodiment, the cap female thread 42 corresponds to "a held portion" held by the inside stopper 14.

Furthermore, the cap 18 is provided with an inside stopper contact surface 44, contacted to the cap contact surface 34 of the inside stopper 14, on the inside thereof. The inside stopper contact surface 44 is made in shape of a taper surface slanting from the outside of the cap 18 to the center of the cap 18 in a direction oriented from an opening of the fit-insertion closed-end hole 40 (the side to which the brush 16 and the distal end portion 27 of the inside stopper 14 are inserted) to the closed end of the fit-insertion closed-end hole 40.

As described above, the outer shape of the cap 18 according to the present exemplary embodiment has the approximately conical shape; however, the outer shape thereof is not limited to this, and for instance, may be approximately prismatic or columnar, or alternatively, may be more complex. Besides, the maximum outer diameter of the cap 18 is preferably set to be less than the outer diameter of the inside stopper 14 at the base end portion 38 provided with the medical solution container body inserted-and-mounted opening 30 (in other words, the outer diameter of the base end portion 38 provided with the medical solution container body inserted-and-mounted opening 30 is greater than or equal to the maximum outer diameter of the cap 18).

It should be noted that the material of the cap 18 is not particularly limited as well, and for instance, may be at least one selected from the group consisting of polypropylene (PP), polyethylene (PE), and acrylonitrile butadiene styrene (ABS). The material of the cap 18 is herein only required not to be extremely inferior in moisture-proofing performance and in stiffness for preventing reduction in torque for opening the cap 18.

(Assemblage of Medical Solution Applying Container 10)

A procedure for manufacturing the medical solution applying container 10 according to the present exemplary embodiment will be briefly explained. First, the brush 16 is attached to the inside stopper 14 by gradually inserting the lower end of the brush 16 into the brush inserted-and-mounted through hole 28 of the inside stopper 14. Subsequently, the brush 16 and the distal end portion 27 of the inside stopper 14 are fittingly inserted into the fit-insertion closed-end hole 40 of the cap 18; then, the cap 18 is turned with respect to the inside stopper 14. Accordingly, the inside stopper male thread 32 of the inside stopper 14 and the cap female thread 42 of the cap 18 are screwed with each other, whereby the cap 18 is held by the inside stopper 14. In this phase, assemblage of the medical solution applying tool 13 is completed.

Next, the medical solution container body 12, which has been preliminarily filled with a predetermined amount of the medical solution L, is assembled to the medical solution applying tool 13 by fittingly inserting the neck portion 20 thereof to the medical solution container body inserted-and-mounted opening 30 of the inside stopper 14 such that the male thread 24, provided on the neck portion 20, is screwed into the female thread 36 provided on the surface of the medical solution container body inserted-and-mounted opening 30 of the inside stopper 14. Accordingly, manufacturing of the medical solution applying container 10 is completed.

(Features of Medical Solution Applying Container 10)

In the medical solution applying tool 13 for the medical solution applying container 10 according to the present exemplary embodiment, the inside stopper 14, composing part of the medical solution applying tool 13, is provided, on the outside thereof, with the inside stopper male thread 32 (holding portion) holding the cap 18 such that the brush 16 and the distal end portion 27 of the inside stopper 14 are fittingly inserted into the fit-insertion closed-end hole 40 of the cap 18, whereas the cap 18 is provided, on the inside thereof, with the cap female thread 42 (held portion) held by the inside stopper male thread 32 (holding portion).

Accordingly, in such a situation that the medical solution applying container 10 is delivered from the manufacturer thereof to the manufacturer of the medical solution L, while being disassembled by separating the medical solution applying tool 13 from the medical solution container body 12, it is made possible to transport the medical solution applying container 10 in a condition that the inside stopper male thread 32 (holding portion) of the inside stopper 14 and the cap female thread 42 (held portion) of the cap 18 are fitted to each other, while the brush 16 and the distal end portion 27 of the inside stopper 14 are fittingly inserted into the fit-insertion closed-end hole 40 of the cap 18.

Therefore, it is made possible to avoid occurrence of a defect that the brush 16 is damaged in the manufacturer of the medical solution L due to interference of the cap 18 with the distal end of the brush 16 caused by mistake when the cap 18 is assembled to the inside stopper 14, hitting the uncovered brush 16 against somewhere, or some kind of accident.

Besides, the inside stopper 14 is provided, on the outside thereof, with the cap contact surface 34 contacted to the inside of the cap 18. The cap contact surface 34 is made in shape of the taper surface slanting from the center of the inside stopper 14 to the outside of the inside stopper 14 in the direction oriented from the distal end of the inside stopper 14, at which the brush 16 is attached to the inside stopper 14, to the opposite side of the distal end.

Furthermore, the cap 18 is provided, on the inside thereof, with the inside stopper contact surface 44 contacted to the outside of the inside stopper 14. The inside stopper contact surface 44 is made in shape of the taper surface slanting from the outside of the cap 18 to the center of the cap 18 in the direction oriented from the opening of the fit-insertion closed-end hole 40 to the closed end of the fit-insertion closed-end hole 40.

Thus, each of the cap contact surface 34 of the inside stopper 14 and the inside stopper contact surface 44 of the cap 18 is made in shape of the taper surface, whereby airtightness made by contact between the inside stopper 14 and the cap 18 can be enhanced and a space enclosing the brush 16 in the fit-insertion closed-end hole 40 is made airtight; hence, it is made possible to avoid occurrence of a situation that the medical solution L undesirably evaporates or leaks from the distal end of the brush 16 during preservation. Besides, the cap contact surface 34 is made in shape of the taper surface slanting from the center of the inside stopper 14 to the outside of the inside stopper 14 in the direction oriented from the distal end of the inside stopper 14, at which the brush 16 is attached, to the inside stopper 14, to the opposite side of the distal end, and is pushed toward the center by the inside stopper contact surface 44, whereby it is made possible to enhance a holding force exerted by the inside stopper 14 to hold the brush 16 inserted and mounted to the brush inserted-and-mounted through hole 28.

It should be noted that in the present exemplary embodiment, each of the cap contact surface 34 and the inside stopper contact surface 44 is made in shape of the taper surface; however, at least either of the cap contact surface 34 and the inside stopper contact surface 44 is only required to be made in shape of the taper surface.

Besides, the inside stopper 14 is provided with the inside stopper male thread 32 (holding portion) in the vicinity of the cap contact surface 34; hence, when the cap female thread 42 (held portion) of the cap 18 is strongly tightened onto the inside stopper male thread 32 (holding portion), the cap contact surface 34 and the inner surface of the cap 18 are strongly pressed against each other, whereby it is made possible to further enhance the airtightness described above.

Furthermore, the inside stopper 14 is provided with the medical solution container body inserted-and-mounted opening 30, to which the neck portion 20 of the medical solution container body 12 is inserted and mounted, on the end portion thereof (the base end portion 38) located on the opposite side of the side to which the brush 16 is attached; besides, the base end portion 38, provided with the medical solution container body inserted-and-mounted opening 30, is set to have an outer diameter greater than or equal to the maximum outer diameter of the cap 18. Therefore, not the outer peripheral surface of the cap 18 but that of the base end portion 38 of the inside stopper 14 is supposed to be held when the medical solution applying tool 13 is assembled to the medical solution container body 12 and when the medical solution applying container 10 is used by the user.

Because of the above, when the medical solution applying tool 13 is assembled to the medical solution container body 12, it is made possible to reliably attach the inside stopper 14 (the medical solution applying tool 13) to the medical solution container body 12. On the other hand, when the medical solution applying container 10 is used by the user, the outer peripheral surface of the base end portion 38 of the inside stopper 14 is held by the user, whereby it is made possible to reduce chances that the temperature of the medical solution L in the medical solution container body 12 is undesirably increased by the body temperature of the user.

(Modification 1)

Figure 3:
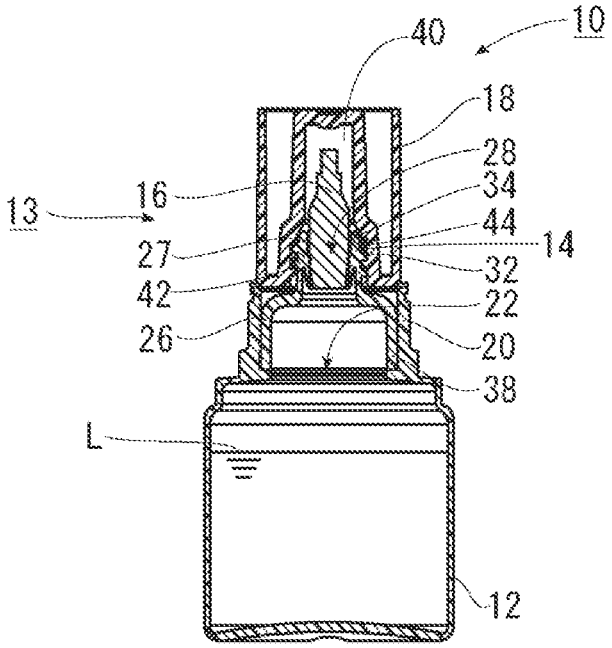
FIG. 3 is a cross-sectional view of the medical solution applying container 10 according to a modification 1.
Figure 4:
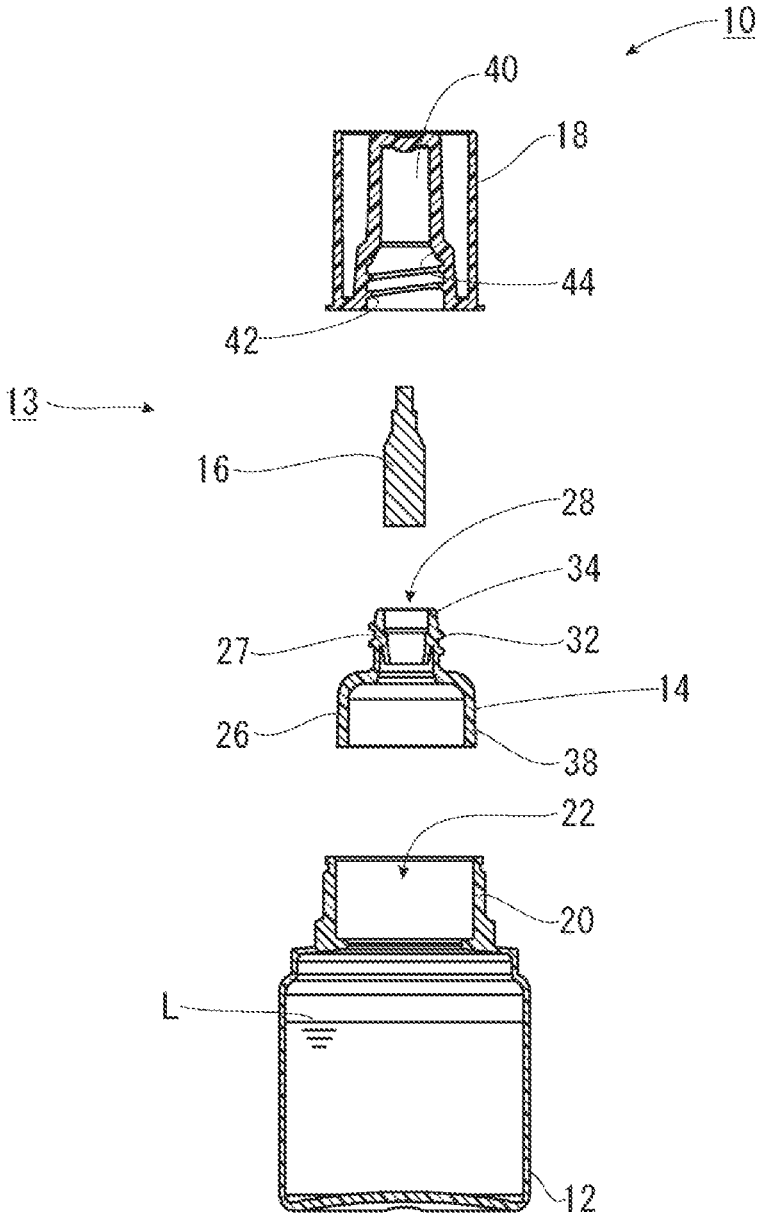
FIG. 4 is an exploded cross-sectional view of the medical solution applying container 10 according to the modification 1.

In the exemplary embodiment described above, the neck portion 20 of the medical solution container body 12 is configured to be fittingly inserted into the medical solution container body inserted-and-mounted opening 30 provided in the base end portion 38 of the inside stopper 14; alternatively, as shown in FIGS. 3 and 4, the base end portion 38 of the inside stopper 14 may be configured to be inserted and mounted to the upper end portion of the medical solution container body 12.

(Modification 2)

Besides, in the exemplary embodiment described above, the inside stopper 14 is provided with the inside stopper male thread 32 as the holding portion, whereas the cap 18 is provided with the cap female thread 42 as the held portion; however, each of the holding portion and the held portion is not required to be made in shape of a thread. For example, the inside stopper 14 may be provided with a recess (or protrusion) on the outer surface thereof, whereas the cap 18 may be provided with a protrusion (or recess) on the inner surface thereof in correspondence to the recess (or protrusion).

(Modification 3)

Figure 5:
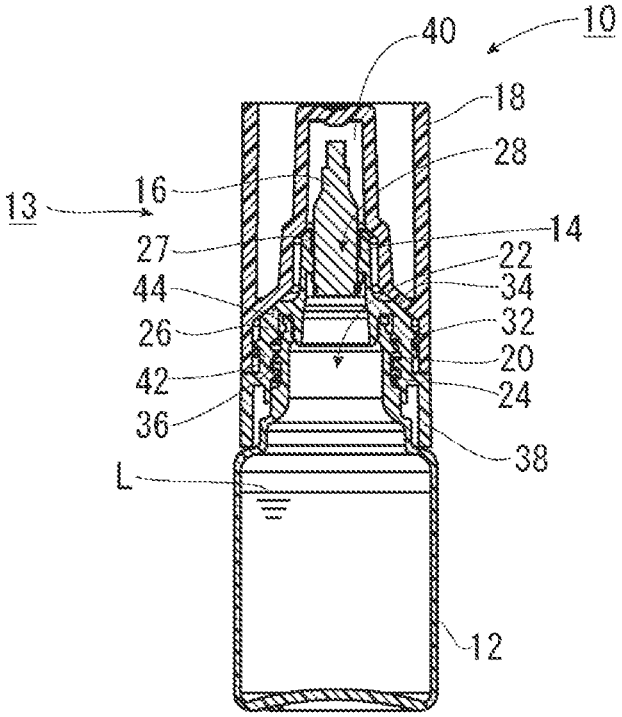
FIG. 5 is a cross-sectional view of the medical solution applying container 10 according to a modification 3.
Figure 6:
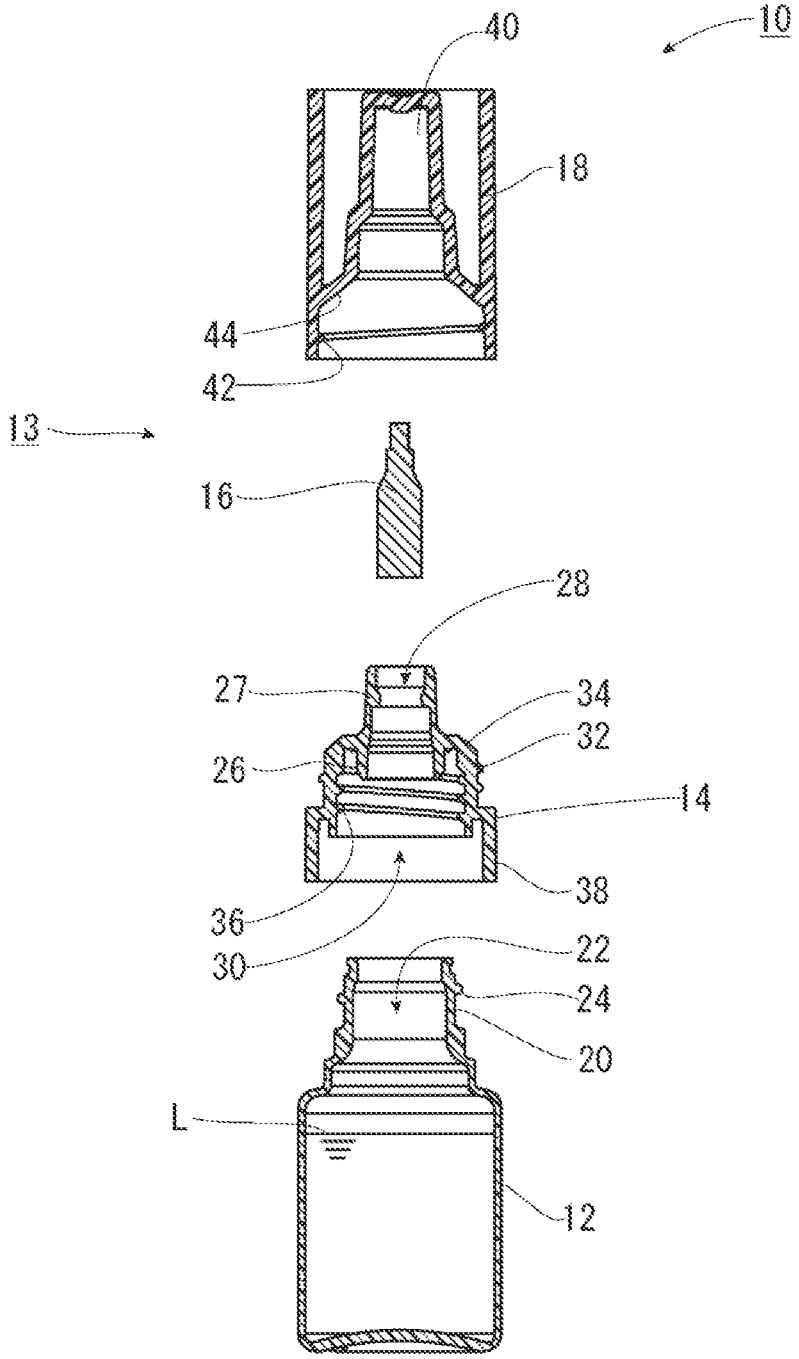
FIG. 6 is an exploded cross-sectional view of the medical solution applying container 10 according to the modification 3.

Furthermore, in the exemplary embodiment described above, the inside stopper 14 is provided with the inside stopper male thread 32 (holding portion) and the cap contact surface 34 on the distal end portion 27; alternatively, as shown in FIGS. 5 and 6, the inside stopper 14 may be provided with the inside stopper male thread 32 and the cap contact surface 34 in a position different from the distal end portion 27 (a middle portion of the inside stopper 14 in the drawings).

Obviously, the cap 18 is herein provided with the cap female thread 42 and the inside stopper contact surface 44 in a position shifted toward the opening of the fit-insertion closed-end hole 40 in accordance with the position of the inside stopper male thread 32 and the cap contact surface 34 of the inside stopper 14.

(Modification 4)

In the exemplary embodiment described above, the inside stopper 14 is provided with the inside stopper male thread 32 as the holding portion, whereas the cap 18 is provided with the cap female thread 42 as the held portion; contrarily, the inside stopper 14 may be provided with an inside stopper female thread as the holding portion, whereas the cap 18 may be provided with a cap male thread as the held portion.

It should be understood that the embodiment herein disclosed is illustrative only and is not restrictive in all aspects. It is intended that the scope of the present invention is indicated by the appended claims rather than the explanation described above and encompasses all the changes that come within the meaning and the range of equivalents of the appended claims.

REFERENCE SIGNS LIST

10 . . . Medical solution applying container, 12 . . . Medical solution container body, 13 . . . Medical solution applying tool, 14 . . . Inside stopper, 16 . . . Brush, 18 . . . Cap, 20 . . . Neck portion, 22 . . . Opening, 24 . . . Male thread, 26 . . . Inside stopper body, 27 . . . Distal end portion (of inside stopper body 26), 28 . . . Brush inserted-and-mounted through hole, 30 . . . Medical solution container body inserted-and-mounted opening, 32 . . . Inside stopper male thread, 34 . . . Cap contact surface, 36 . . . Female thread, 38 . . . Base end portion (of inside stopper body 26), 40 . . . Fit-insertion closed-end hole, 42 . . . Cap female thread, 44 . . . Inside stopper contact surface, L . . . Medical solution

What is claimed is:

1. A medical solution applying tool comprising:

a brush;

an inside stopper having a brush inserted-and-mounted through hole, wherein the brush inserted-and-mounted through hole has an upper opening and a bottom opening, wherein the brush is inserted into the upper opening of the brush inserted-and-mounted through hole; and a cap including a fit-insertion closed-end hole into which the brush and a distal end portion of the inside stopper are fittingly inserted, wherein the inside stopper is provided with a holding portion, the holding portion holding the cap such that the brush and the distal end portion of the inside stopper are fittingly inserted into the fit-insertion closed-end hole, the cap is provided with a held portion, the held portion held by the holding portion, the inside stopper includes a medical solution container body inserted-and-mounted opening to which a neck portion of a medical solution container body is inserted and mounted, the medical solution container body inserted-and-mounted opening is provided in an end portion of the inside stopper, and the end portion is located on an opposite side of the end at which the brush is attached to the inside stopper, and the brush is disposed inside the brush inserted-and-mounted through hole, and an entire bottom surface of the brush is exposed from the bottom opening of the brush inserted-and-mounted through hole to the medical solution container body inserted-and-mounted opening.

2. The medical solution applying tool according to claim 1, wherein the holding portion is made in shape of either a male or female thread, and the held portion is made in shape of either a female or male thread.

3. The medical solution applying tool according to claim 1, wherein the inside stopper is provided with a cap contact surface on an outside thereof, the cap contact surface contacted to an inside of the cap, and the cap contact surface is made in shape of a taper surface slanting from a center of the inside stopper to the outside of the inside stopper in a direction oriented from a distal end of the inside stopper to an opposite side of the distal end, the distal end being an end at which the brush is attached to the inside stopper.

4. The medical solution applying tool according to claim 1, wherein the cap is provided with an inside stopper contact surface on an inside thereof, the inside stopper contact surface contacted to an outside of the inside stopper, and the inside stopper contact surface is made in shape of a taper surface slanting from an outside of the cap to a center of the cap in a direction oriented from an opening of the fit-insertion closed-end hole to a closed end of the fit-insertion closed-end hole.

5. The medical solution applying tool according to claim 3, wherein the holding portion is provided in a vicinity of the cap contact surface.

6. The medical solution applying tool according to claim 4, wherein the held portion is provided in a vicinity of the inside stopper contact surface.

7. The medical solution applying tool according to claim 1, wherein the end portion provided with the medical solution container body inserted-and-mounted opening has an outer diameter greater than or equal to a maximum outer diameter of the cap.

8. A medical solution applying container comprising:

the medical solution applying tool recited in claim 1; and a medical solution container body storing therein a medical solution.

* * * * *